United States Patent [19]

Rullier et al.

[11] Patent Number: 4,974,867

[45] Date of Patent: Dec. 4, 1990

[54] APPARATUS FOR ABSORBING SHOCKS AND VIBRATIONS BETWEEN A SKI AND A SKI BINDING

[75] Inventors: Pierre Rullier; Maurice Legrand, both of Annecy, France

[73] Assignee: Salomon S.A., Annecy Cedex, France

[21] Appl. No.: 397,354

[22] Filed: Aug. 23, 1989

Related U.S. Application Data

[63] Continuation of Ser. No. 187,520, Apr. 19, 1988, abandoned.

[30] Foreign Application Priority Data

Aug. 20, 1986 [FR] France ..... 86 12092

[51] Int. Cl.[5] ..... A63C 5/00; A63C 9/00

[52] U.S. Cl. ..... 280/607; 280/609

[58] Field of Search ..... 280/601, 607, 609, 11.14, 280/617, 618, 626

[56] References Cited

U.S. PATENT DOCUMENTS

| | | | |
|---|---|---|---|
| 3,917,298 | 11/1975 | Haff | 280/607 |
| 4,046,400 | 9/1977 | Viletto | 280/626 |
| 4,061,348 | 12/1977 | Carter | 280/11.14 X |
| 4,139,214 | 2/1979 | Meyer | 280/607 |
| 4,294,460 | 10/1981 | Kirsch | 280/607 |
| 4,465,295 | 8/1984 | Spademan | 280/617 |
| 4,627,179 | 12/1986 | McElroy | 36/44 |
| 4,722,946 | 2/1988 | Hostettler | 528/65 X |
| 4,789,177 | 12/1988 | Graillat | 280/607 |

FOREIGN PATENT DOCUMENTS

| | | | |
|---|---|---|---|
| 2255406 | 5/1974 | Fed. Rep. of Germany . | |
| 2363562 | 7/1974 | Fed. Rep. of Germany . | |
| 2363596 | 8/1974 | Fed. Rep. of Germany . | |
| 2713325 | 10/1977 | Fed. Rep. of Germany . | |
| 3632853 | 5/1987 | Fed. Rep. of Germany | 280/607 |
| 2109654 | 5/1972 | France . | |
| 2231401 | 12/1974 | France . | |
| 2409776 | 6/1979 | France . | |
| 2565117 | 12/1985 | France . | |
| 39116 | 5/1907 | Switzerland | 280/609 |
| 412671 | 11/1966 | Switzerland | 280/609 |
| 8303360 | 10/1983 | World Int. Prop. O. . | |

OTHER PUBLICATIONS

Chemical Engineers' Handbook, 5th Ed., Perry & Chilton, McGraw-Hill Book Co., 1973, pp. 8-9.

*Primary Examiner*—Charles A. Marmor
*Assistant Examiner*—Tamara L. Finlay
*Attorney, Agent, or Firm*—Sandler, Greenblum & Bernstein

[57] ABSTRACT

An apparatus located between a ski and a binding mounted thereon, including at least one shock absorption buffer positioned partially in a seat cut-away with respect to the most elevated portion of the ski and extending beyond this portion at rest. The comfort of the skier and the steering of the skis is enhanced without raising the binding with respect to the ski by utilizing the natural cut-aways. The cut-aways are created during the manufacture of the ski or are provided in the thickness of the ski after manufacture. The buffer is then installed within the seat thus cut-away, rather than merely installed on the upper surface of the ski. The buffer is preferably made of viscoelastic material.

19 Claims, 3 Drawing Sheets

FIG.9
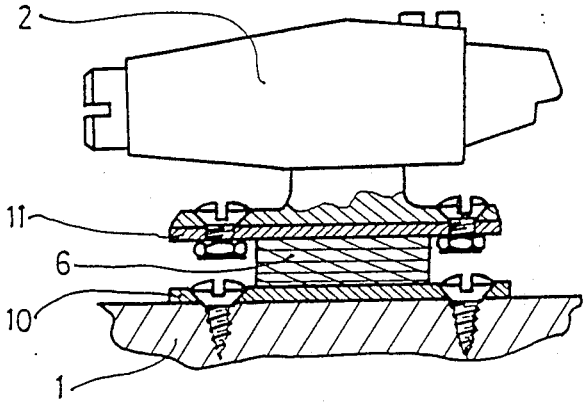
FIG.10
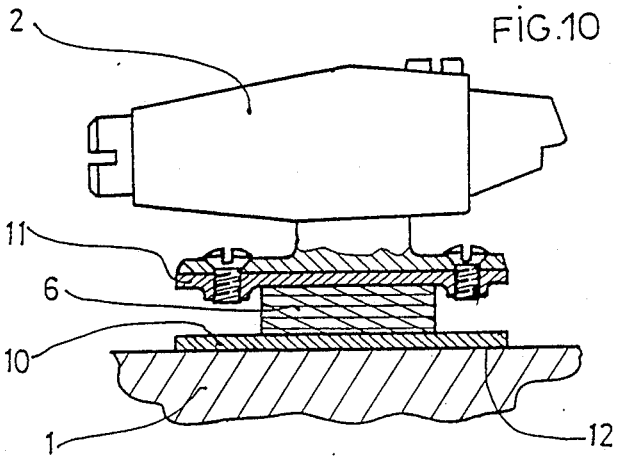
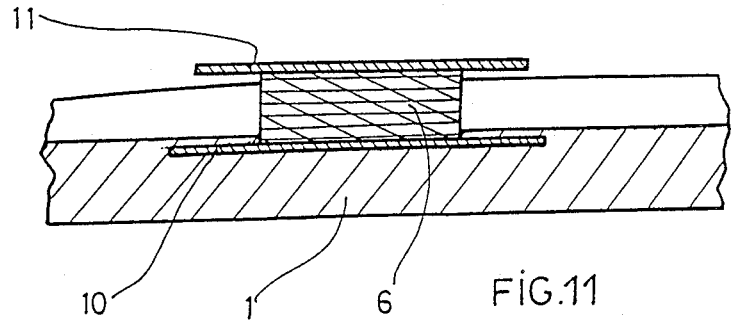
FIG.11

APPARATUS FOR ABSORBING SHOCKS AND VIBRATIONS BETWEEN A SKI AND A SKI BINDING

This application is a continuation of application Ser. No. 187,520, filed Apr. 19, 1988, now abandoned.

BACKGROUND OF THE INVENTION

1. Field of the Invention

The present invention relates to shock absorbers interposed between the binding of the boot and the ski for both alpine or cross-country.

2. Description of Background and Relevant Information

These apparatus are adapted to improve the comfort of the skier as well as the behavior and performance of the skis. Without shock absorbers, all the irregularities of the slopes, which are harder and harder as they become more and more compressed, subject the ski to shocks and vibrations which are transmitted directly to the skier whose skeleton, joints, muscles and tendons are very stressed, which results not only in a discomfort but also in a fatigue which can lead to accidents. Furthermore, the too rigid linkage between the skier and the ski detracts from good steering of the ski, particularly due to a too substantial gripping of the edges in the snow which causes undesirable braking.

A certain number of attempts have been made to resolve these problems. Thus, in German Document No. 27 13 325 there is proposed a leaf spring apparatus positioned between the upper planar surface of the ski and a heel binding base plate and fixed on it by a screw, a corner of rubber can where necessary be added. Besides the fact that only a vertical shock absorption can be obtained, this apparatus raises to a substantial extent the foot of the skier with respect to the ski, which has the substantial disadvantage of diminishing the mastery and stability of the skier during steering of the ski.

In German Document No. 2 363 562, a thin elastic blade is mounted between the upper planar surface of the ski and the base plate of the binding. This blade is adapted to allow for freer flexions of the ski to which the binding adds too much rigidity, and by virtue of its low thickness, would not provide sufficient shock absorption to the degree sought.

Another attempt is made in WIPO Document No. 83/03360. A shock absorber constituted by an elastomeric layer and at least one metallic layer is positioned between the upper planar surface of the ski and the bindings. Its construction is relatively complex and likewise lifts to a substantial extent the boot with respect to the ski.

Furthermore, in German Document No. 2 255 406 there is described an apparatus which facilitates turns by allowing for an inclination of the binding with respect to the ski around a fixed longitudinal axis against an elastic return element. Besides its mechanical complexity and mass, this apparatus, for which it is not in reality designed, would not act as one might otherwise think, to serve the role of shock absorber sought except to a very small degree for torsional biases around the longitudinal axis.

The apparatus which have just been described have at least one major disadvantage: they are not adapted to give the desired shock absorption affect, or, mounted above the upper surface of the ski, they lift the boot in a manner such that steering of the ski is substantially affected, and a lateral shock absorption is not obtained to other than a negligible degree. Furthermore, it should be noted that none of the systems is adapted to be mounted on a ski which does not have a transverse rectangular cross-section.

SUMMARY OF THE INVENTION

It is these disadvantages that the invention attempts to overcome by proposing a shock absorption apparatus which is partially positioned between the ski and the binding in a seat cut away with respect to the more elevated portion of the profile of the ski at the level of the binding and extending beyond at rest the level of this more elevated portion.

BRIEF DESCRIPTION OF THE DRAWINGS

For the comprehension of the description of the invention which follows, reference is made to the drawings, in which:

FIGS. 1, 2 and 3, illustrate another embodiment of an apparatus according to the invention;

FIGS. 8–11 illustrate methods of mounting shock absorbers according to the invention.

DESCRIPTION OF THE PREFERRED EMBODIMENTS

Figure 1:
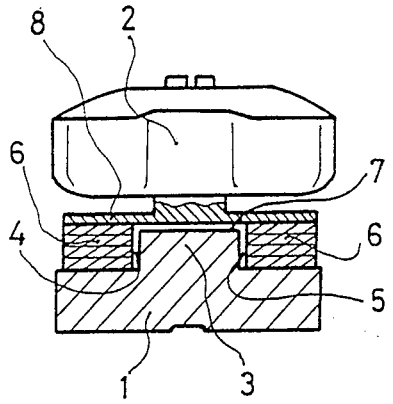
FIG. 1 illustrates a first embodiment of the apparatus according to the invention, in transverse cross-section with respect to a ski.

FIG. 1 illustrates a first embodiment of the invention. A ski 1 is shown in transverse cross-section, or in right cross-section, at the level of a binding 2 for the boot of the skier. In the thickness of ski 1 are provided on both side a central projection portion 3 of the cut-aways which can be symmetrical 4, 5 and in which are positioned shock absorber buffers 6. These buffers 6 rest through their lower surface on the bottom of cut-outs 4, 5 and exceed in height, at rest, the upper level 7 of the central projecting portion 3 of ski 1. On these shock absorber buffers 6 is mounted base plate 8 of binding 2. Shock absorber buffers 6 are preferably of rectangular cross-section and occupy all or part of the space of cut-outs 4, 5 in a manner so as to be able to have relatively free play, essentially in the vertical direction with respect to the lateral edges of projection 3. These buffers 6 have elastic properties allowing for the absorption of the sudden mechanical biases between ski 1 and plate 8, and we will come back to their individual constitution further below. By virtue of their play, buffers 6 are adapted to absorb both vertical vibrations as well as lateral and longitudinal vibrations, as well as torsional moments along the three principal axes of pitching, rolling or nosing. In all cases, the more elevated portion of ski 1, i.e., the upper level 7 of projection 3 serves as an abutment for limiting of the amplitude of the deformations of buffers 6.

Figure 2:
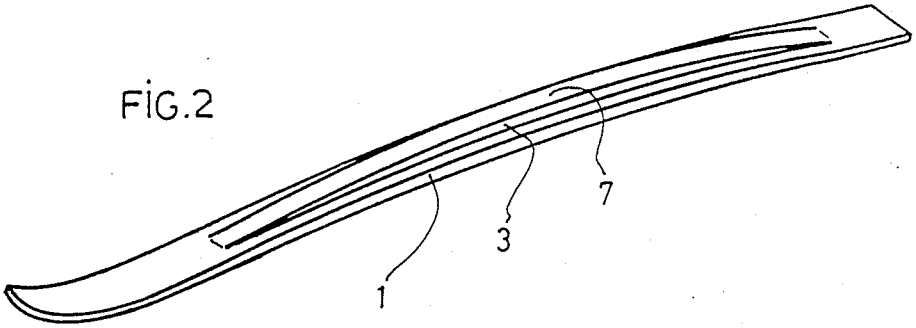
FIG. 2 illustrates one type of ski having a central longitudinal projection to which the embodiment of FIG. 1 can be applied.

The seats or lateral cut-outs 4, 5 which receive the buffers can be provided at the level of the one or more bindings in the thickness of a conventional ski 2, having a rectangular cross-section. As already explained above, for skis 1 having a longitudinal projection 3, which may or may not continue over the major portion of the length of ski 1 which are increasingly common, and as is shown in FIG. 2, it suffices to utilize the natural lateral cut-outs resulting from the manufacture of the ski 1.

Figure 3:
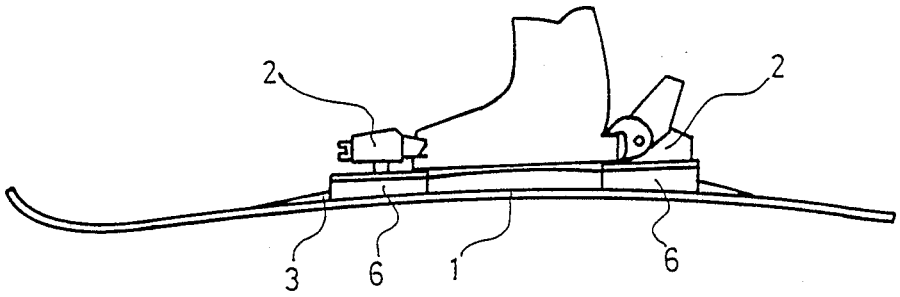
FIG. 3 illustrates a lateral view of a ski with a boot inserted of the type shown in FIG. 2 to which an apparatus according to the invention is applied for a front binding and a rear binding.

FIG. 3 illustrates one such type of ski 1 having central projection 3 equipped with shock absorption buffers 6 at the level of a front binding and a rear binding 2.

Figure 4:
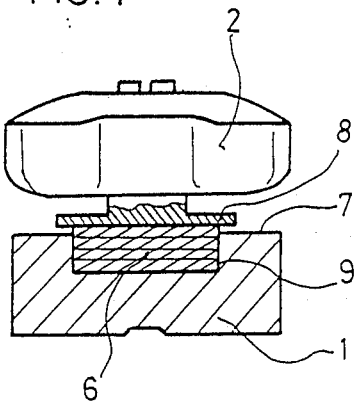
FIGS. 4, 5 and 6, which are homologous respectively to preceding
Figure 5:
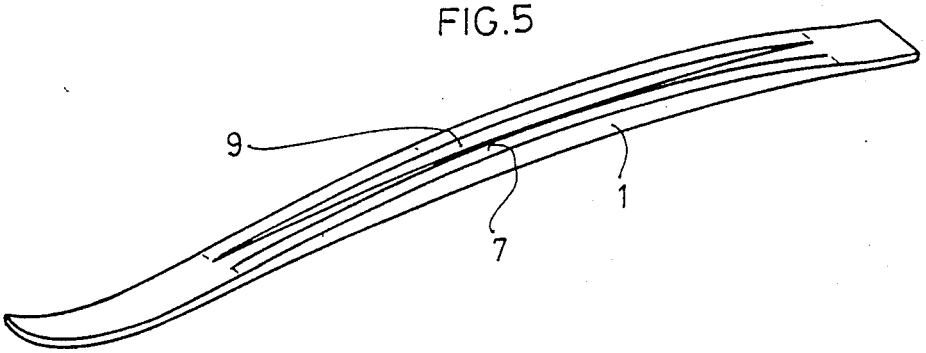
Figure 6:
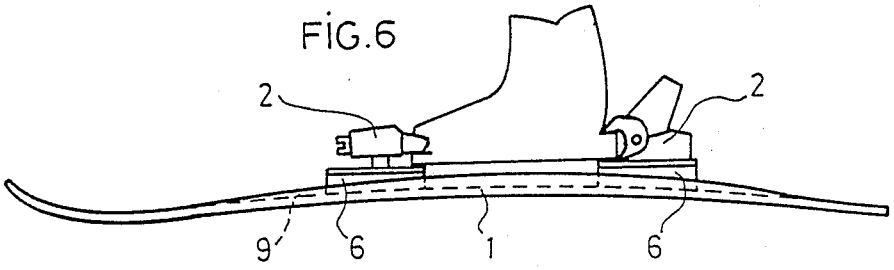

FIGS. 4, 5 and 6 relate to another embodiment of the invention. In this case, for each binding 2, one does not rely upon lateral shock absorption buffers 6, but on a single central buffer 6. This one, dimensioned as a result to be adapted to encase the same biases, is positioned at the level of binding 2 in a seat 9 provided in the thickness of ski 1, while being able preferably to move relatively freely along the length of the edges thereof.

As to the rest, that which has previously been stated remains the case with the necessary changes having been made, the upper surface 7 of the ski, serving as an amplitude limiting abutment for displacement, being now on both sides of central buffer 6.

FIG. 5 illustrates a ski 1 having initially a longitudinal central hollowed-out shape 9 which thus does not necessitate providing in the thickness of the ski the necessary seats, and FIG. 6 illustrates the manner in which such a ski 1 can be equipped with shock absorption buffers 6 for a front binding and rear binding 2.

In view of the technical effect sought, the shock absorption buffers 6 can be constituted of any material and in any appropriate manner for the effect sought, the essential being that, partially positioned in the cut-outs with respect to the upper surface of ski 1, they raise only very slightly, at rest, with respect to this surface, the binding of the boot and thus do not interfere with the mastery of the skier of steering, as is the case in the closest solutions which can be found in the prior art.

Preferably, the shock absorption buffers 6 are in the form of blocks, generally parallepipedic and made fast to ski 1 in the corresponding seat, and to binding 2. The material utilized, rather than having the pure properties of rubber, i.e., almost without absorption of a portion of the energy applied in its deformation, will preferably be viscoelastic, thus having a significant shock absorption coefficient within the range from a value clearly distinct from zero to a value on the order of 1.2. As a function of the effect sought, its hardness is preferably a range within from 35–65 Shore A. Materials allowing for the result expected, i.e., a very reasonable shock absorption without disturbing a good steering of the skis, can be selected from amongst certain polyurethanes, polyisoprene, polyisobutylene, and polyisoxylane.

Figure 7:
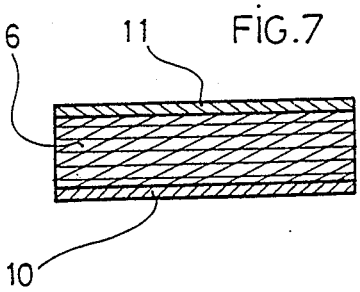
FIG. 7 illustrates one appropriate form of shock absorber within the scope of the invention.

The blocks constituting the shock absorption buffers 6 can be directly glued to ski 1 in the corresponding cut-out and the base plate of binding 2 can likewise be applied directly by gluing on the block. However, it appears more advantageous to utilize the buffers having a sandwich structure where the shock absorption viscoelastic material 6 is already fastened according to known techniques between a lower metallic base plate 10 and an upper plate 11, distinct or not from the base plate of binding 2, as illustrated by way of example in FIG. 7.

Figure 8:
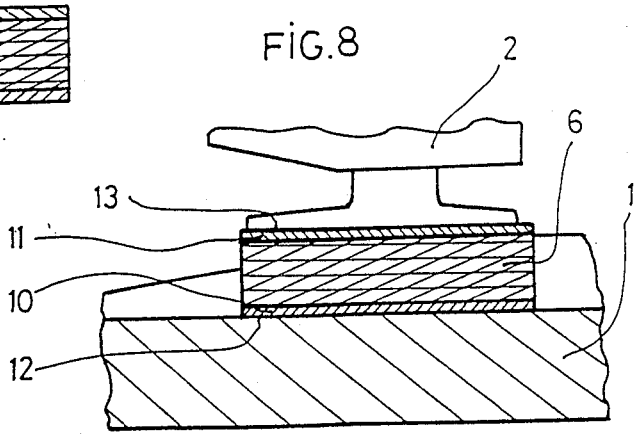

FIG. 8 illustrates a mounting possibility of such a shock absorber on a ski 1, the cut-away not being shown, the fastening occurring between ski 1 and binding 2 by layers of glue 12 and 13.

One can likewise provide that the metallic plates 10 and 11 of the sandwich can be otherwise fixed than by gluing alone. Thus, FIG. 9 illustrates a mounting by screwing or battery of plate 10, on ski 1 and of binding 2, on upper plate 11 of shock absorption buffer 6. FIG. 10 illustrates one embodiment where buffer 6 is glued at 12 through its lower plate 10 on ski 1 and where binding 2 is screwed on upper plate 11 of the sandwich of buffer 6.

Likewise, as illustrated in FIG. 11, the shock absorption buffer 6 can, instead of being applied ultimately on ski 1, be mounted directly and embedded therein thereon during its manufacture.

Of course, the invention is not limited to the particular embodiments described and extends to all equivalent means, materials, and embodiments falling with the scope of the claims.

We claim:

1. A shock and vibration absorption apparatus to be located between a ski and a binding of a shoe or boot of a skier, comprising at least one shock and vibration absorption buffer at least partially positioned in at least one seat located at a portion of said ski where said binding is to be attached, and extending beyond the height of said portion, wherein said apparatus is to be used with a ski having a longitudinally extending central projection and wherein said at least one seat comprises two lateral seats provided on both sides of said longitudinally extending central projection of said ski to each receive a shock and vibration absorption buffer.

2. Apparatus according to claim 1, wherein each said shock and vibration absorption buffer is constituted by a viscoelastic material block.

3. Apparatus according to claim 2, wherein said block is at least on one surface fastened to a metallic plate.

4. Apparatus according to claim 2, wherein the viscoelastic material has a shock absorption coefficient which is at most equal to 1.2.

5. Apparatus according to claim 2, wherein the viscoelastic material has a hardness between 35 and 65 Shore A.

6. Apparatus according to claim 2, wherein the viscoelastic material is made of polyurethane.

7. Apparatus according to claim 2, wherein the viscoelastic material is made of polyisoprene.

8. Apparatus according to claim 2, wherein the viscoelastic material is made of isobutylene.

9. Apparatus according to claim 2, wherein the viscoelastic material is made of polyisoxylane.

10. Apparatus according to claim 1, wherein each shock and vibration absorption buffer is fixed to said ski in its seat and to said binding by gluing.

11. Apparatus according to claim 1, in combination with a ski, further comprising a plate attached to a lower portion of each of said at least one shock and vibration absorption buffer, wherein said plate is embedded within said ski.

12. The apparatus according to claim 1, wherein said at least one shock and vibration absorption buffer comprises a material having a substantially uniform shock and vibration absorption capacity.

13. Apparatus according to claim 1, wherein each shock and vibration absorption buffer is fixed to said skit in its seat and to said binding by screwing.

14. Apparatus according to claim 1, wherein each said seat has a predetermined dimension, and wherein each said shock and vibration absorption buffer comprises a corresponding dimension which is less than said predetermined dimension to thereby permit said shock and vibration buffer to have relatively free play within its respective seat.

15. Apparatus according to claim 1, in combination with said binding.

16. Apparatus according to claim 1, in combination with said ski.

17. Apparatus according to claim 1, in combination with said binding and said ski.

18. Apparatus according to claim 1, wherein said buffer is adapted to enable the binding to move vertically, laterally, and longitudinally relative to the ski.

19. A shock and vibration absorption apparatus to be located between a ski and a binding of a shoe or boot of a skier comprising at least one shock and vibration absorption buffer at least partially positioned in at least one seat located at a portion of said ski where said binding is to be attached, and extending beyond the height of said portion, wherein said at least one shock and vibration absorption buffer comprises an upper surface and a lower surface and wherein said upper surface, in its entirety, is movable perpendicularly toward said lower surface to absorb shocks and vibrations.

* * * * *